United States Patent [19]

Bogdanov et al.

[11] Patent Number: 4,923,127

[45] Date of Patent: May 8, 1990

[54] BALL TUBE MILL

[76] Inventors: Vasily S. Bogdanov, ulitsa Kostjukova 36, kv. 103, Belgorod; Viktor S. Platonov, ulitsa Lenina, 52a, kv. 10, Cherkessk; Nikolai S. Bogdanov, bulvar Pervogo Saljuta, 4, kv. 84, Belgorod; Jury G. Bedko, ulitsa Dovatora, 82, kv. 39, Cherkessk; Ivan I. Miroshnichenko, ulitsa Kostjukova, 36, kv. 63, Belgorod; Nikolai D. Vorobiev, ulitsa Kostjukova, 36, kv. 3, Belgorod, all of U.S.S.R.

[21] Appl. No.: 183,788

[22] Filed: Apr. 20, 1988

[51] Int. Cl.[5] ..... B02C 17/06

[52] U.S. Cl. ..... 241/70; 241/78; 241/176

[58] Field of Search ..... 241/70, 71, 72, 78, 241/171, 176, 179, 180, 182

[56] References Cited

U.S. PATENT DOCUMENTS

| | | | |
|---|---|---|---|
| 3,294,325 | 12/1966 | Nelson | 241/70 |

FOREIGN PATENT DOCUMENTS

| | | | |
|---|---|---|---|
| 2567773 | 1/1986 | France | 241/72 |
| 795560 | 1/1981 | U.S.S.R. . | |
| 961761 | 9/1982 | U.S.S.R. . | |
| 1031506 | 7/1983 | U.S.S.R. | 241/72 |
| 1261707 | 10/1986 | U.S.S.R. | 241/72 |
| 1278020 | 12/1986 | U.S.S.R. | 241/70 |

*Primary Examiner*—Joseph M. Gorski

*Attorney, Agent, or Firm*—Lilling & Greenspan

[57] ABSTRACT

A ball tube mill in which an inclined wall dividing a housing of the mill into coarse and fine grinding chambers is fabricated from rigidly interconnected rods forming therebetween through slots for the passage of the material being ground. Part of each slot in the area of contact of the inclined wall with the grinding bodies at the side of the fine grinding chamber has a width smaller than the part of each slot at the remaining portion of the inclined wall at the side of the fine grinding chamber.

3 Claims, 2 Drawing Sheets

BALL TUBE MILL

FIELD OF THE INVENTION

This invention relates to the art of comminuting hard materials, and more particularly to ball tube mills.

The invention can find application in the cement industry, in mining, and for other industrial uses, where fine comminuting of materials is essential.

PRIOR ART

There is known a ball tube mill comprising a cylindrical housing accommodating a wall arranged at an inclination to the longitudinal centerline of the cylindrical housing and dividing the interior of the housing into coarse and fine grinding chambers filled with grinding bodies. The housing of the ball tube mill is enclosed at the opposite ends by cover plates having charging and discharging ports, and is kinematically linked with a drive for rotating the housing about its longitudinal centerline.

The inclined wall is fabricated from rods rigidly interconnected therebetween, placed equidistantly through the length of the rods, and forming slots for the passage of the material being ground. The slots therefore have equal width at all the sections of the inclined wall, viz., both in the area of contact of its surface with the grinding bodies in the two chambers of the mill, and in the areas not contacting with the grinding bodies (cf., e.g., USSR Inventor's Certificate No. 795,560 published in Bulletin "Discoveries, Inventions, Industrial Designs, Trademarks" No. 2, Jan. 15, 1981).

The following takes place with such an arrangement of the inclined wall.

In the position of the housing of the mill, when the level of the grinding bodies present in the course grinding chamber is above the level of the grinding bodies occupying the fine grinding chamber, the material being ground tends to fall through the slots in the inclined wall from the coarse grinding chamber to the fine grinding chamber, which conforms with the conditions of material comminution in the ball tube mill.

In the position of the housing turned 180°, when the level of the grinding bodies present in the fine grinding chamber is above the level of the grinding bodies in the coarse grinding chamber, a back spill of the material from the fine grinding chamber to the coarse grinding chamber occurs.

This affects not only the throughput capacity of the inclined wall, but also reduces the efficiency of the grinding process in general.

It is an object of this invention to increase the throughput capacity and production efficiency of a ball tube mill.

The aim of the invention is attained by that in a ball tube mill, in which an inclined wall dividing a housing of the mill into coarse and fine grinding chambers is fabricated from rods rigidly interconnected therebetween to form through slots for the passage of the material being ground, according to the invention, part of each slot in an area of contact of the inclined wall with grinding bodies at the side of the fine grinding chamber has a width, which is smaller than part of each slot at the remaining portion of the inclined wall at the side of the fine grinding chamber.

Preferably, part of each slot in the area of contact of the inclined wall with the grinding bodies present in the fine grinding chamber has a width equal to between 0.15 and 0.30 of the minimal diameter of the grinding bodies present in the fine grinding chamber, whereas the width of the part of each slot in the remaining portion of the inclined wall equals to between 0.30 and 0.60 of the minimum diameter of the grinding bodies present in the coarse grinding chamber.

Such a width of the slots prevents the passage of the grinding bodies through the slots from the coarse grinding chamber to the fine grinding chamber, and vice versa.

Advisably, the rods of the inclined wall are arranged in a fan-like fashion to form slots diverging from an area of contact of the inclined wall with the grinding bodies present in the fine grinding chamber toward an area of contact with the grinding bodies present in the coarse grinding chamber.

This arrangement of the rods forming the inclined wall is easier to fabricate; it also ensures such a shape of the slot as to reduce the hydraulic resistance, and minimize back spill of the material from the fine grinding chamber to the coarse grinding chamber, whereby the throughput capacity of the wall is substantially increased.

Advantageously, attached to the rods of the inclined wall in the area of contact with the grinding bodies are wire elements secured at the intersection of planes tangent to the surface of the adjacent rods and passing through a line connecting the centers of the rods and normals extending toward these planes from the centers of the rods, the diameter of the wire elements amounting to between 0.1 and 0.2 the diameter of the rod of the inclined wall.

The aforedescribed arrangement of the inclined wall minimizes clogging of the slots with broken particles of the grinding bodies and the material being ground.

The ball tube mill according to the invention features a relatively high throughput capacity of the material being ground through the inclined wall; another advantage of the ball tube mill embodying the present invention is that back spill of the material being ground from the fine grinding chamber to the coarse grinding chamber is minimized; in addition, the slots of the inclined wall are less susceptible to be clogged with broken particles of the grinding bodies and material being ground, which enables to substantially increase the efficiency of the grinding process carried out by the proposed ball tube mill.

BRIEF DESCRIPTION OF THE DRAWINGS

The invention will now be described in greater detail with reference to various specific embodiments thereof taken in conjunction with the accompanying drawings, in which.

Figure 8:
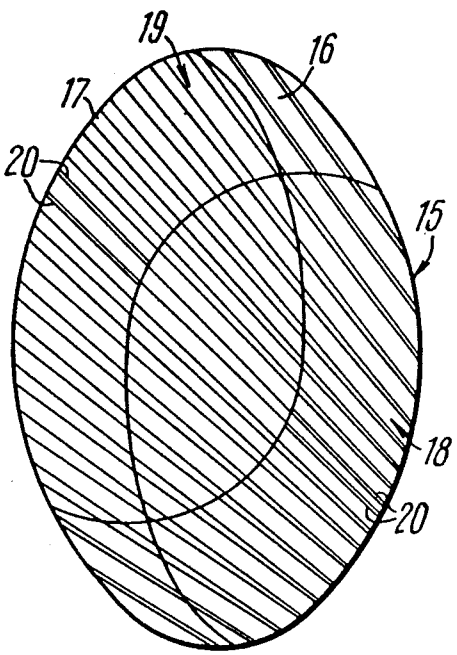
FIG. 8 represents an inclined interchamber wall with fan-like arrangement of the rods.

A ball-tube mill comprises a housing 1 (FIGS. 1 and 2) enclosed at the opposite ends by cover plates 2. Trunnions 3 of the housing 1 are journalled in bearings (not shown), whereas the housing 1 is kinematically linked with a rotation drive (not shown).

Secured inside the housing 1 is an inclined wall 4, hereinafter referred to as wall 4, arranged at an angle $\alpha$ to the longitudinal centerline of the housing 1 and having the form of an ellipse. The wall 4 divides the interior of the housing 1 into a coarse grinding chamber 5 and a fine grinding chamber 6. The chambers 5 and 6 are occupied by grinding bodies 7 and 8, respectively. The grinding bodies 7 occupying the chamber 5 are of larger size than the grinding bodies 8 present in the chamber 6.

The wall 4 is made up of interconnected rod elements 9 (FIGS. 3 and 4) arranged in parallel with the small axis of the ellipse of the wall 4 and having stepped portions 9*a* and 9*b* to form through slots for the passage of the particles of materials being ground, each of these slots being defined by portions 10 and 11, hereinafter referred to as slots 10 and 11.

Area 12 of contact of the wall 4 with the grinding bodies 8 present in the fine grinding chamber 6 is confined by line 13 and outer contour 14 of the wall 4.

The portion 9*a* of the rod 9 in the area 12 has a diameter D (FIG. 5) substantially greater than the diameter d (FIG. 6) of the remaining portion 9*b* of the rod 9. The width "a" (FIG. 5) of the slots 10 in the area 12 (FIG. 3) is less than the width "b" (FIG. 5) of the slots 11 (FIGS. 6 and 7) at the remaining part of the wall 4.

The slots 10 (FIG. 3) in the area 12 have a width "a" (FIG. 5) equal to between 0.15 and 0.30 of the minimum diameter of the grinding bodies 8 (FIG. 1) present in the fine grinding chamber 6. This size of the slots 10 (FIG. 3) prevents the passage of the grinding bodies 8 (FIG. 1) from the fine grinding chamber 6 to the coarse grinding chamber 5.

The slots 11 (FIGS. 3 and 4) at the remaining part of the wall 4 have a width "b" (FIGS. 6 and 7) equal to between 0.30 and 0.60 of the minimum diameter of the grinding bodies 7 (FIGS. 1 and 2) present in the coarse grinding chamber 5. Such a size of the slots 11 prevents the passage of the grinding bodies 7 (FIGS. 1 and 2) present in the coarse grinding chamber to the fine grinding chamber 6.

In another alternative modification of the inclined wall 15 (FIG. 8) rods 16 have invariable diameter through their length and are arranged in a fan-like fashion to form slots 17 diverging from area 18 of contact of the surface of the wall 15 with the grinding bodies 8 (FIGS. 1 and 2) present in the fine grinding chamber 6 toward area 19 (FIG. 8) of contact of the surface of the wall 15 with the grinding bodies 7 (FIGS. 1 and 2) occupying the coarse grinding chamber 5.

This arrangement of the wall 15 is much simpler to construct.

In order to avoid clogging of the slots 10 (11, 17) with particles of broken grinding bodies 7 and 8 and with the material being ground, wire elements 20 (FIGS. 5 and 7) are attached to the rods 9 (16) in the areas 12 (12*a*) (FIG. 4) and 18, 19 (FIG. 8) of contact of the surface of the wall 4 (15) with the grinding bodies 7 and 8 present in the chambers 5 and 6, respectively. These wire elements 20 are secured to each rod 9 (16) at the opposite sides thereof at the intersection if imaginary planes 21 (FIG. 7) tangent to the surfaces of the adjacent rods 9 (16) and extending through at line 22 connecting the centers of the rods 9 (16) and normals 23 extending from the centers of the rods 9 (16) to these planes 21.

The diameter of the wire element 20 amounts to between 0.1 and 0 2 of the diameter of the rod 9(16) of the wall 4 (15).

Such a diameter and arrangement of the wire elements 20 relative to the rods 9 (16), while not affecting the width of the slots 10, 11 (17), prevent clogging thereof with particles of broken grinding bodies 7, 8 and the material being ground.

The ball tube mill according to the invention operates in the following manner.

Figure 1:
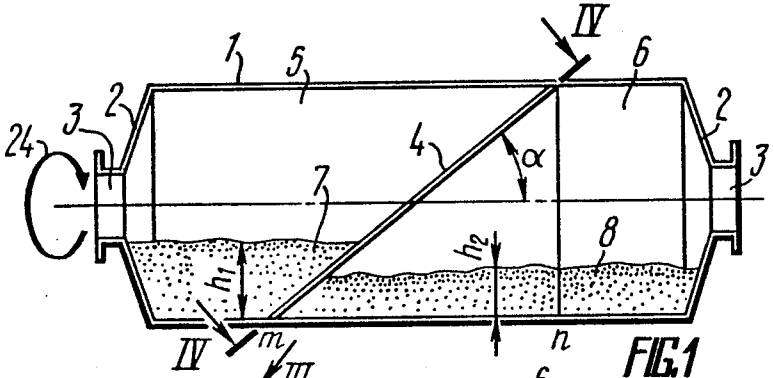
FIG. 1 is a longitudinal sectional view of a a ball tube mill according to the invention.
Figure 2:
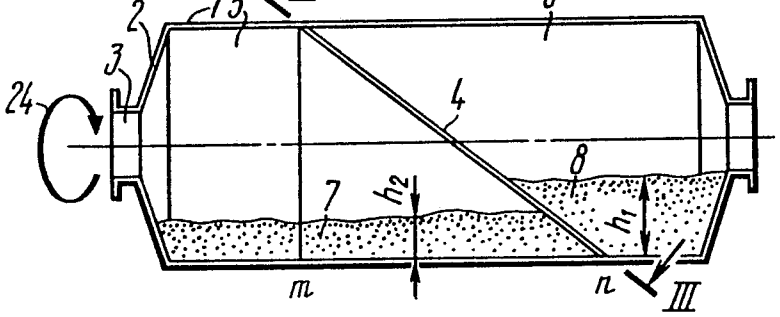
FIG. 2 shows the same ball tube mill turned 180°.

As the housing 1 of the mill rotates in the direction indicated by the arrow 24 in FIGS. 1 and 2, the wall 4 assumes successively typical positions illustrated in FIGS. 1 and 2 with the level of the grinding bodies 7, 8 in the chambers 5, 6 to change from the maximum $h_1$ (FIG. 1) to the minimum $h_2$.

During each revolution of the housing 1 of the mill the grinding bodies 7 in the coarse grinding chamber 5 and the grinding bodies 8 in the fine grinding chamber 6 move transversely of the housing 1 and grind the material predominantly by impact; the grinding bodies further reciprocate along the centerline of the housing 1 thanks to the arrangement of the wall 4 at the angle $\alpha$ to the centerline to grind the particles of the material by attrition.

The mass of charge (i.e., grinding bodies and the material being ground) present in the chamber 5 at the section "mn" of the housing 1 is retained by the wall 4 (FIG. 2), and in the coarse of rotation of the housing 1 in the direction 24 is caused to slide along the surface of the wall 4 in the area 12*a* (FIG. 4) thereof. Therewith, particles of the material being ground fall through the slots 10, 11 between the rods 9 from the coarse grinding chamber 5 to the fine grinding chamber 6, wherein the grinding bodies 8 act to further reduce the particles of the material in size to the end product.

During their travel along the surface of the wall 4 in the area 12*a* particles of broken grinding bodies and large particles of the material being ground are not jammed in the slots 10, 11 since the wire elements 20 act to retain them. Therewith, the particles retained by the wire elements 20 project above the plane of the wall 4. The mass of charge moving along the wall 4 acts on the particles of broken grinding bodies and largesize particles of the material to force them from the slots 10, 11. These particles again enter the chamber 5, where they are reduced to a size smaller than the width of the slots 10, 11. In the position of the housing represented in FIG. 1 the particles of the material fall through the slots 10, 11 of the wall 4 from the chamber 5 to the chamber 6.

Figures 3, 4, 5, 6, 7:
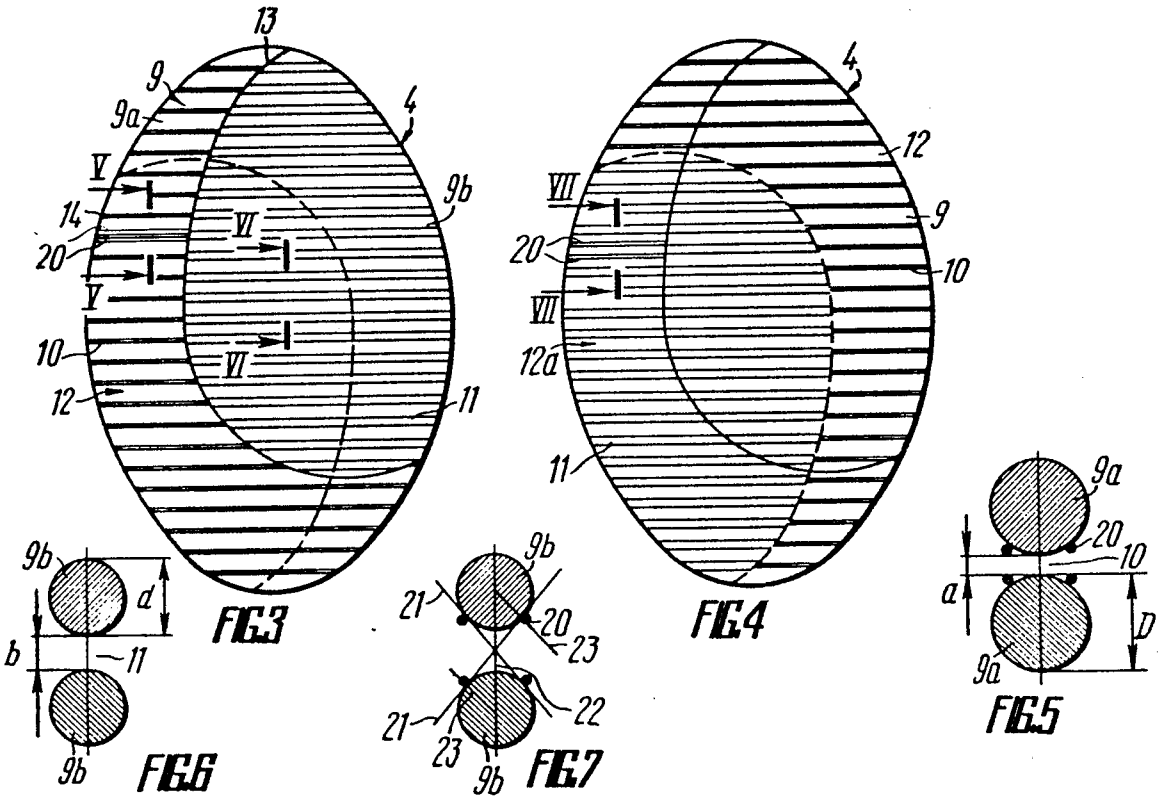
FIG. 3 is an enlarged section taken along the line III—III in FIG. 2.
FIG. 4 is a sectional taken along the line IV—IV in FIG. 3 on an enlarged scale.
FIG. 5 is a section taken along the line V—V in FIG. 3 on an enlarged scale.
FIG. 6 is a section taken along the line VI—VI in FIG. 3 on an enlarged scale.
FIG. 7 is a section taken along the line VII—VII in FIG. 4 on an enlarged scale.

As the housing 1 of the mill rotates, it assumes the position shown in FIG. 2. The mass of charge at the section "mn" (FIG. 1) in the fine grinding chamber 6 is retained by the wall 4 to move along the surface of the wall 4 and leave a trace thereon confined by the area 12 (FIG. 3).

In the position of the housing 1 represented in FIG. 2 the particles of material being ground fall from the fine grinding chamber 6 to the coarse grinding chamber 5. Because the width "a" of the slots 10 in the area 12 of contact with the grinding bodies 8 present in the fine grinding chamber 6 is substantially less than the width "b" of the slots 11 occupying the remaining part of the wall 4 a substantially smaller mass of the material being ground tends to spill back from the chamber 6 to the chamber 5.

The provision of the wire elements 20 at the portion 9*a* of the rods 9 (FIG. 5) prevents clogging of the slots 11 in the area 12 of the wall 4 for the same reason as clogging of the slots 10 in the area 12*a* is prevented.

Since the width of the slots 10 is less than the minimum diameter of the grinding bodies 7 present in the coarse grinding chamber 5, the grinding bodies 7 fail to flow to the fine grinding chamber 6. As the grinding bodies 7 wear out, they are reduced in size to less than the width "a" of the slots 10, and pass through the wall 4 to the fine grinding chamber 6 to function further until complete wear.

Thanks to the width of the slots 10 amounting to 0.15–0.30 (85–70%) of the minimum diameter of the grinding bodies 8 present in the fine grinding chamber 6, they fail to transfer from the fine grinding chamber 6, to the coarse grinding chamber 5. After the grinding bodies 8 has been reduced in size (as a result of wear) by 50–60%, they are replaced. Particles of the material entering the fine grinding chamber 6 are comminuted to the end product to be evacuated from the chamber 6 through a hole (not shown) in the trunnion 3.

The cycle is then repeated.

Operation of the ball tube mill modification with the wall 15 proceeds substantially in a similar manner.

A pilot model of the proposed ball tube mill having a housing 4 meters across and 15.5 meters in length provided with an inclined wall made up from rods has been used for comminuting clinker.

It has been found in the course of its operation that the back spill of the material being ground from the fine grinding chamber to the coarse grinding chamber is minimized. Therefore, the efficiency of the grinding process (as compared with the prototype appartaus) has been enhanced substantially to result in a 20% increase in the production efficiency of the ball tube mill. In addition, the use of the inclined wall with slots between the rods thereof having different widths ensured a higher throughput capacity of the inclined wall, reduced the aerodynamic resistance thereof, made the process of grinding more efficient, and impoved the suction conditions.

What is claimed is:

1. A ball tube mill comprising:

a housing;

a coarse grinding chamber in said housing containing coarse grinding bodies;

a fine grinding chamber in said housing containing, fine grinding bodies;

an inclined wall dividing said housing into said coarse and fine grinding chambers and defining first and second contacting areas respectively contacting said fine and coarse grinding bodies during rotation of said housing, said inclined wall being formed by a plurality of spaced rods defining slots between said rods to ensure the passage therethrough of a material being ground, part of each slot in said first contacting area having a width which is smaller than a width of part of each said slot in said second contacting area; and wire elements attached to each rod in the areas of contact with the grinding bodies each wire element being parallel, attached and tangent to its respective rod, and being located in a plane which is tangent to each of two immediately adjacent rods along lines along which the wire elements are attached, with associated planes intersecting each other along a line which intersects a line that connects centers of these two immediately adjacent rods

2. The ball tube mill as defined in claim 1, in which part of each slot in the area of contact of the inclined wall with the grinding bodies present in said fine grinding chamber has a width equal to between 0.15 an 0.30 of a minimal diameter of said fine grinding bodies, whereas the width of the part of each said slot in the remaining portion of said inclined wall is between 0.30 and 0.60 of a minimum diameter of said coarse grinding bodies.

3. The ball tube mill as defined in claim 1, wherein the diameter of each wire element is between 0.1 and 0.2 of the diameter of each rod.

* * * * *